United States Patent [19]

Green

[11] Patent Number: 4,562,781

[45] Date of Patent: Jan. 7, 1986

[54] HOOK BAR CLAMP ASSEMBLY FOR TUFTING MACHINE

[75] Inventor: Jerry T. Green, Hixson, Tenn.

[73] Assignee: Tuftco Corporation, Chattanooga, Tenn.

[21] Appl. No.: 676,738

[22] Filed: Nov. 29, 1984

[51] Int. Cl.[4] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 4,217,837 | 8/1980 | Beasley et al. | 112/79 R |
| 4,313,388 | 2/1982 | Biggs et al. | 112/79 R |
| 4,354,441 | 10/1982 | Hurst | 112/79 R |
| 4,448,137 | 5/1984 | Curtis et al. | 112/79 R |
| 4,477,957 | 10/1984 | Inman | 112/79 R |
| 4,509,439 | 4/1985 | Densmore et al. | 112/79 R |

*Primary Examiner*—Ronald Feldbaum

*Attorney, Agent, or Firm*—Harrington A. Lackey

[57] ABSTRACT

A looper apparatus for a multiple-needle tufting machine having a hook bar including a transversely extending recess opening through the front face of the hook bar and receiving a transverse gauge bar or member having transversely spaced vertical hook slots for receiving the shank portions of corresponding looper hooks. A clamp assembly including a plurality of clamp members assembled within the lower portion of the gauge bar so that each clamp member is adapted to engage the bottom edges of the shank portions of a pair of adjacent hooks in clamping position. Each clamp member is adapted to be moved to its clamping position by a corresponding set screw extending upwardly through the lower portion of the gauge bar. The clamp members are preferably in the form of clamp balls.

11 Claims, 15 Drawing Figures

HOOK BAR CLAMP ASSEMBLY FOR TUFTING MACHINE

BACKGROUND OF THE INVENTION

This invention relates to a hook bar assembly for a multiple needle tufting machine, and more particularly to a clamp assembly for a tufting machine hook bar.

The conventional hook bars for multiple-needle tufting machines are long bars extending transversely of the machine below the needles and the base fabric. A conventional cut-pile hook bar has deeply elongated slots formed through its bottom face and uniformly spaced for receiving the hooks which cooperate with the needles to form loops in the yarns carried by the needles. For a narrow gauge, multiple-needle tufting machine, the looper slots in the hook bar must be formed close together. The closeness of the spacing of the looper slots is limited by the thinness of the walls between the slots. Conventional loopers or hooks are held in their respective slots by individual set screws which are threaded into each slot and engage the opposed walls or lands of the slots. Thus, the thinness of the walls is further limited by the diameters of the set screws. Moreover, the threaded movement of the set screws tends to expand and warp the slot walls or lands.

The prior U.S. Pat. No. 4,448,137 of Kenneth C. Curtis, et al, for "MODULAR HOOK BAR WITH GAUGE INSERT FOR TUFTING MACHINE" discloses a hook bar having a recess opening and within which is inserted an elongated transverse gauge bar or gauge member having transversely spaced hook slots for receiving the respective tufting hooks. Each of the shank portions of the corresponding hooks is clamped in the gauge bar by means of an upwardly directed set screw. One set screw is provided for each hook. Each set screw is directed upwardly and rearwardly at an angle to the bottom edge of the hook shank to bite into the force upwardly and rearwardly the shank of the tufting hook. In the Curtis hook bar, the gauge may be narrowed by staggering the set screws. Nevertheless, the gauge of the hooks, and therefore the gauge of the needles, is limited by spacing of the set screws and the set screw holes.

In some instances in which the above Curtis hook bar is made of soft material, there has been a tendency of the front-opening recess, receiving the gauge bar and the hooks, to open up because of the pressure exerted by the set screws against the individual hooks, forcing the hooks and the gauge bar upwardly against the upper surface of the recess. Even with the slightest opening of the recess, that is the spreading or separation of the top and bottom surfaces of the recess, the shanks of the hooks become loose within the recess. The loose hooks then become disaligned, lose their gauge, and interfere with the operation of their corresponding knives and needles. Moreover, the more the set screws are tightened, the looser the hooks become.

Another difficulty resulting from the utilization of a set screw with each individual hook, is that if each set screw is not exactly centered relative to its corresponding hook, the upward force of the set screw tends to push the hook to one side against the adjacent land of the gauge bar. The adjacent land bends to push against the hook on the opposite side of the land, which in turn pushes the next adjacent hook to produce a domino effect and a cumulative loosening and disalignment of the hooks with respect to the needles and knives.

Furthermore, where a set screw is employed for clamping each individual looper hook, the finer the gauge, the thinner the material separating the set screw holes, with consequent weakening and bending or even fracturing of the material between the set screw holes, both in the hook bar and in the gauge inserts or gauge bars.

As disclosed in the Curtis et al U.S. Pat. No. 4,448,137, the ends of hook bar sections or modules are lapped or offset to eliminate the problem of thin set screw walls at the ends of the hook bar sections. Such overlapped hook bar sections increase the difficulty of removing a hook bar section from the center of a machine because of the inter-locking or overlapping ends of the hook bar sections. Accordingly, with such overlapping hook bar sections, more time is required to replace or remove hook bar sections in the middle of the tufting machine.

Another type of hook bar or looper apparatus for mounting a plurality of looper hooks close together in order to provide a more narrow gauge for multiple-needle tufting machines, is disclosed in U.S. Pat. No. 4,217,837 of Max M. Beasley, et al, issued Aug. 19, 1980, for FINE GAUGE LOOPER APPARATUS FOR IN-LINE TUFTING MACHINE. In this looper apparatus, the hook slots are formed in an insert bar received in the front face of the hook bar, and the looper hooks are held in position by a plurality of clamp members threadedly secured to the hook block and against the front body portions of the looper hooks. The hook bars are made in the form of elongated modules which are mounted end-to-end, and each of the clamp members is adapted to secure a limited number of hooks upon the hook bar module.

In U.S. Pat. No. 4,445,446, of Max M. Beasley for KNIFE HOLDER MODULE FOR CUT PILE TUFTING MACHINE, clamp members in the form of cylindrical inserts are utilized to hold pairs of knives within the knife block members. Since the filing date of U.S. Pat. No. 4,445,446, the common assignee Tuftco Corporation, has substituted clamp balls for the cylindrical inserts to secure the pairs of knives within the knife block members with relative success. However, it was not obvious to use clamp balls to secure pairs of loop hooks because loop hooks are subject to different stresses and forces than are the tufting knives. Moreover, the hooks and knives serve different functions in the tufting process, i.e., seizing the yarn loop and cutting the yarn loop, respectively. Furthermore, the hooks and knives occupy different positions and attitudes. The hook shanks are substantially horizontal, while the knives are substantially vertical and are disposed at compound tension and pitch angles relative to the hooks.

SUMMARY OF THE INVENTION

It is therefore an object of this invention to provide in a multiple-needle tufting machine, particularly adapted for cut pile tufting, an improved looper apparatus having a hook bar with a special clamp assembly for securing the hooks within the hook bar.

The looper apparatus made in accordance with this invention is adapted for utilization in staggered needle, cut pile tufting machines or in-line (single needle row) tufting machines having coarse gauges or narrow gauges in the order of 1/10–$\frac{1}{4}$".

More specifically, the looper apparatus made in accordance with this invention includes an elongated hook bar of solid material having a transverse recess opening forward and receiving an elongated transverse gauge member or gauge bar having a plurality of transversely spaced vertical hook slots for receiving the shank portions of the corresponding tufting hooks. A unique clamp assembly is adapted to cooperate with the gauge member including a single clamp member for clamping each adjacent pair of tufting hooks within the hook bar. Each clamp member, preferably in the form of a clamp ball or sphere, is adapted to be controlled by a single set screw threaded in a corresponding hole within the bottom portion of the hook bar. Thus, the same number of hooks can be clamped within the hook bar with only half as many set screws as previously used in conventional hook bars. Because of the smaller number of set screws, the set screws may be arranged closer together to permit the tufting hooks and therefore the needles to be arranged on a more narrow gauge.

With fewer set screws needed to secure tufting hooks within a hook bar, the installation and replacement of the tufting hooks can be accomplished in substantially less time. Moreover, the set screws can be larger for strength as well as to reduce the likelihood of stripping the hex socket in the head of a small set screw when tightened with an Allen wrench.

A lesser number of set screws permits spacing the end set screw in a hook bar farther away from the end so that the threads do not break through the end of the hook bar. Accordinoly, hook bar sections having flush end faces may be utilized which may be butted together without a lap joint. Furthermore, no double hooks are needed at the joints. By elimination of the lap joints, a hook bar section with the clamp assembly made in accordance with this invention, may be quickly removed in the center of the machine for replacement, inspection or repair.

In a preferred form of the invention, the clamp members are preferably spherical clamp balls received within cavities within the lower portion of the gauge member, in alignment with each corresponding set screw and intercepting the lower portions of a pair of adjacent hook slots to permit the clamp ball to be forced upward into the lower portions of the hook slots for engaging the bottom edges of a pair of adjacent hooks.

The clamp balls permit an equal distribution of pressure transmitted from the set screw to the adjacent pair of hooks. Moreover, the bottom edges of the hooks are not burred by the clamp ball as they are by the sharp edges of individual inclined set screws.

In the clamp assembly including the clamp balls or spheres as the clamp members, the hook slots of the gauge member open upwardly. The gauge member or insert is solid at the bottom, except for the ball cavities, so that the hook shanks are free to move upward in the slots against the top inner surface of the recess, in clamping position.

In a modified form of a clamp assembly made in accordance with this invention for mounting low profile hooks which are desirable for very narrow gauge, multiple-needle tufting machines, the hook bar is made with a relatively thin top wall which is integrally joined by horizontally spaced vertical spacer flanges to the bottom portion of the hook bar, to provide clearance between the inclined knives and adjacent hooks.

In a preferred form of the invention, the body portion or neck portion of each looper has a rearwardly facing vertical rear shoulder which snugly engages the front face of the hook bar above the recess for stabilized support of the looper hooks. Moreover, transversely spaced lands project from the front face of the hook bar or from the front face of the gauge member on opposite sides of the neck portions of each looper hook for further stabilizing the looper hooks. These lands define vertical grooves between the lands which are in the same vertical planes as the corresponding hook slots.

DESCRIPTION OF THE PREFFERRED EMBODIMENTS

Figures 1, 2, 3, 4, 5:
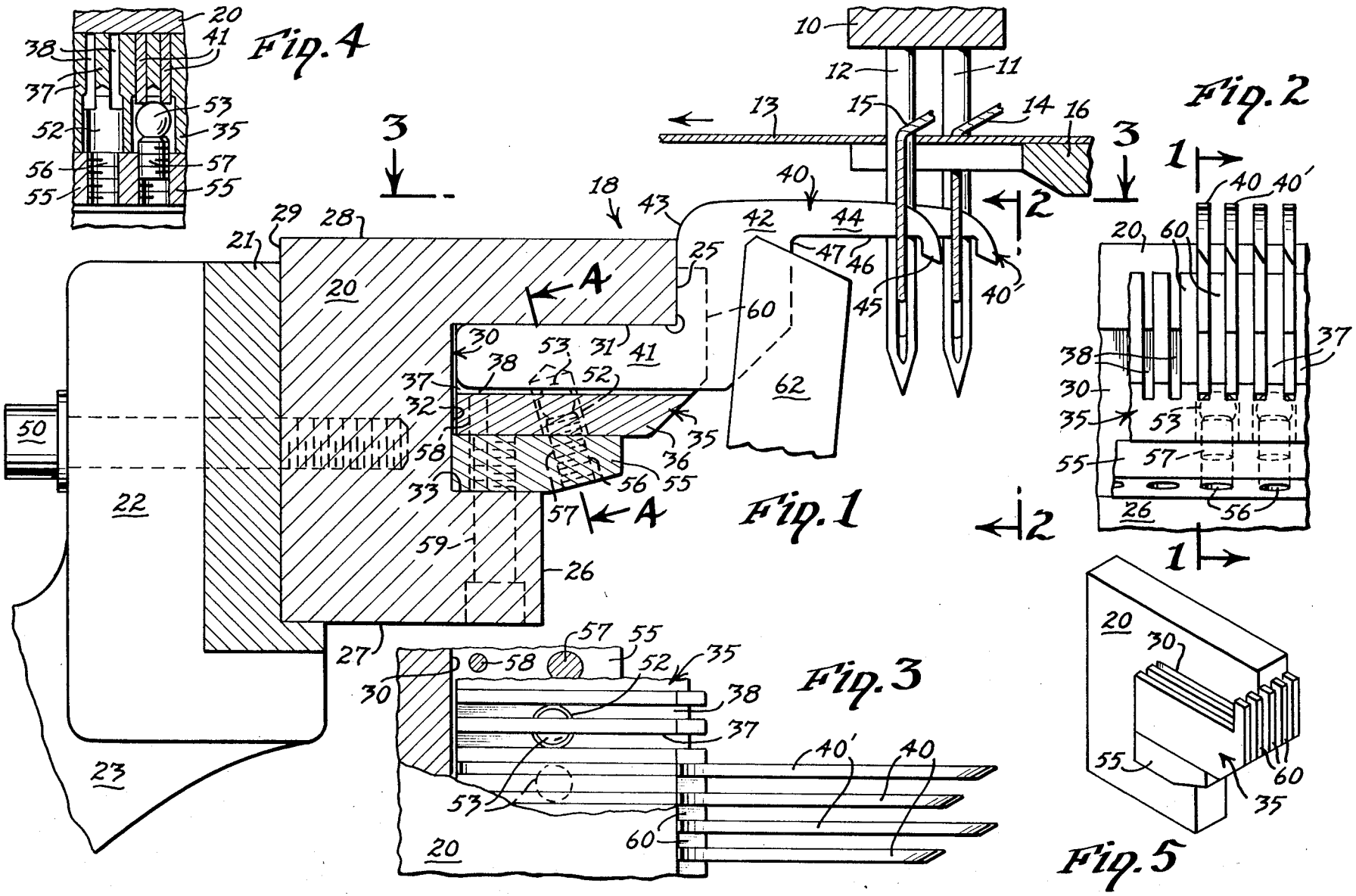
FIG. 1 is a fragmentary sectional elevation taken along the line 1—1 of FIG. 2, longitudinally through a portion of a narrow gauge, staggered-needle tufting machine, incorporating a cut pile looper apparatus made in accordance with this invention, and disclosing the needles and looper hooks in operative loop-forming forming positions, and further disclosing one form of the clamp assemby.
FIG. 2 is a fragmentary, front elevation of the looper apparatus, taken along the line 2—2 of FIG. 1.
FIG. 3 is a fragmentary, top plan view of the looper apparatus taken along the line 3—3 of FIG. 1, with portions broken away.
FIG. 4 is an enlarged fragmentary section taken along the lin 4—4 of FIG. 1.
FIG. 5 is a reduced top front perspective view of the clamp assembly of FIGS. 1–4 with the looper hooks removed.

Referring now to the drawings in more detail, FIG. 1 discloses a transverse needle bar 10 in a conventional multiple-needle tufting machine supporting a first row of uniformly spaced rear needles 12 offset preferably mid-way between the front needles 11, to provide a uniform, narrow gauge, staggered needle tufting machine. The needle bar 10 is vertically reciprocated by conventional means, not shown, to cause the front and rear needles 11 and 12 to move between an upper position above the base fabric 13 to a lower position penetrating the base fabric 13, so that the needles will carry yarns, such as yarns 14 and 15, through the base fabric 13 to form loops of tufting therein.

The base fabric 13 is supported upon a needle plate 16 for movement, by means not shown, in the direction of the arrow of FIG. 1, that is longitudinally from front-to-rear through the machine.

The looper apparatus 18 which cooperates with the needles 11 and 12 includes a transverse hook bar 20 of unique construction, which may be fixed upon an elongated shim bar 21, which in turn is supported upon a bracket 22 corresponding with a rocker arm 23 journaled on a rock shaft, not shown, and driven by conventional means connected to the rocker arms 23 for limited reciprocable movement in synchronism with the reciprocal movement of the needles 11 and 12.

The hook bar 20 has an upper portion and a lower portion and a front face which includes an upper front face portion 25, a lower front face portion 26 and a bottom surface 27. The hook bar 20 also includes a top surface 28 and a rear vertical transverse surface 29.

Formed in the solid metal hook bar, or hook bar module 20, is an elongated transversely extending recess 30 which opens forward through the upper and lower face portions 25 and 26, and is open in the transverse direction of the recess 30, but is otherwise closed to form the top surface 31, rear surface 32 and bottom surface 33.

Received within the recess 30 is an elongated transversely extending gauge member, gauge insert, or gauge bar 35 comprising an elongated bottom wall or bottom wall portion 36 from which project upwardly a plurality of uniformly transversely spaced lands 37 between which are formed hook slots 38. The hook slots 38 are uniformly transversely spaced at the same gauge as the needle gauge and are disposed in parallel vertical planes, so that the hook slots 38 extend from front to rear completely through the gauge member 35 and open through the top portion of the gauge member 35.

Each looper hook 40 has a body portion including a substantially elongated, relatively straight, rearward projecting shank or shank portion 41 adapted to fit within the major portion of the corresponding hook slot 38. The neck or head 42 of the looper hook 40 forming a part of the body portion defines a rear vertical surface or shoulder 43 which intersects the shank portion 41. Projecting forward from the neck or head 42 of the looper hook 40 is an elongated bill 44 having a barbed free end portion 45 and defining a bottom cutting edge 46 intersecting the throat 47.

The rear face 29 of the hook bar 20 may be adapted to snugly seat within a transverse recess formed in the front face of the shim bar 21. The hook bar 20 is held securely against the shim bar 21 by a plurality of transversely spaced bolts 50 extending through the bracket 22.

The clamp assembly made in accordance with this invention for securing the looper hooks 40 and 40' within the hook slots 38 includes a plurality of transversely spaced cavities 52 formed within the lower wall portion 36 of the gauge member 35. Each cavity 52 extends upward through the lower wall portion 36 far enough to intercept a pair of adjacent hook slots 38. Each cavity 52 is preferably cylindrical and drilled to extend upward and rearward and has a longitudinal axis which is mid-way between the corresponding pair of hook slots 38, as best disclosed in FIGS. 2, 3 and 4. The cavity 52 is large enough to freely receive a clamp member in the form of a clamp sphere or ball 53, which is adapted to be moved high enough within the cavity 52 to extend into the lower portions of a corresponding pair of hook slots 38 and engage the bottom edges of the shanks 41 of the corresponding pair of hooks 40. The periphery of the ball 53 is tangent along the inner bottom corners of the adjacent pair of shanks 41 in clamped position as disclosed in FIGS. 2 and 4. In clamped position, the top edges of the shanks 41 engage the top surface 31 of the recess 30, as best disclosed in FIGS. 1 and 4.

Adapted to occupy the space within the lower portion of the recess 30 is an elongated clamping insert 55. Formed within the clamping insert 55 are a plurality of transversely spaced, threaded ed holes 56 adapted to threadedly receive corresponding set screws 57.

The threaded holes 56 are also preferably inclined upwardly and rearwardly and are coaxial with the ball cavities 52. Thus, a set screw 57 threadedly engaging the corresponding threaded hole 56 in the clamping insert 55 can be projected upwardly within the ball cavity 52 to engage the clamp ball 53 and force it upward against the opposed inner bottom corners of the adjacent shanks 41 of a pair of adjacent hooks 40 and 40'.

In the embodiment of the clamp assembly disclosed in FIGS. 1–5, the diameter of each of the set screw holes 52 is less than the diameter of the corresponding clamp ball 53, as well as the diameter of the ball cavity 52. Thus, when the clamping insert 55 is in its operative assembled position, as disclosed in the drawings, each clamp ball 53 is trapped or captive within its corresponding cavity 52, even when its corresponding set screw 57 is completely removed from the set screw hole 56. Such structure eliminates the inadvertent loss of a clamp ball 53 when the corresponding set screw 57 is completely removed from the clamping insert 55.

In order to lock the clamp balls 53 within their respective cavities 52, the clamping insert 55 may be secured flush against the bottom surface of the bottom wall portion 36 of the gauge member 35 by means of vertical dowel pins 58. Thus, the gauge member 35 and the clamping insert 55 may be handled as a unit when inserted and removed from the recess 30 of the hook bar 20.

When the gauge member 35 and the clamping insert 55 are secured together as a unit by the dowel pins 58 and inserted into the recess 30, the clamping insert 55 may be secured in the recess 30, by means of vertically extending bolts 59 (FIG. 1).

Although the combined height of the clamping insert 55 and the gauge member 35 is disclosed in the drawings as being equal to the height of the recess 30, nevertheless, the height of the gauge member 35 may be slightly less than shown, so long as the upper edges of the shanks 41 can be forced against the top surface 31 of the recess 30 by the clamp balls 53.

As best disclosed in FIG. 2, there is a single cavity 52, clamp ball 53, and set screw 57 for each pair of looper hooks 40 and 40'. Each successive adjacent pair of hooks 40 and 40' is provided with a clamp ball 53.

Thus, there are twice as many hooks 40 and 40' and hook slots 38 as there are clamp balls 53 and set screws 57.

Each of the lands 37 projects forward beyond the front face 25 of a hook bar 20 to form vertical stiffener extensions 60 to form reinforcing spacer elements between the hooks 40 and 40', as best disclosed in FIGS. 2 and 3.

Thus, when each looper hook 40 and 40' is received within their corresponding hook slots 38, preferably the rear shoulder 43 of each hook 40 fits between a pair of adjacent stiffener extension 60 and bears against the front face portion 25 of the hook bar 20.

As disclosed in FIGS. 1 and 3, the looper hooks 40 and 40' have bills of different lengths alternating to cooperate with the staggered needles 12 and 11, in a well known manner, so that the throats 47 of the respective hooks are in transverse alignment.

Cooperating with each of the looper hooks 40 and 40' is a conventional cut pile knife 62 (FIG. 1), which is adapted to be reciprocated in a conventional manner in synchronism with the reciprocation of the hook bar 20 for cooperation with the respective needles 11 and 12 to catch and cut the yarns 14 and 15 in order to form cut pile loops, not shown.

Figure 6:
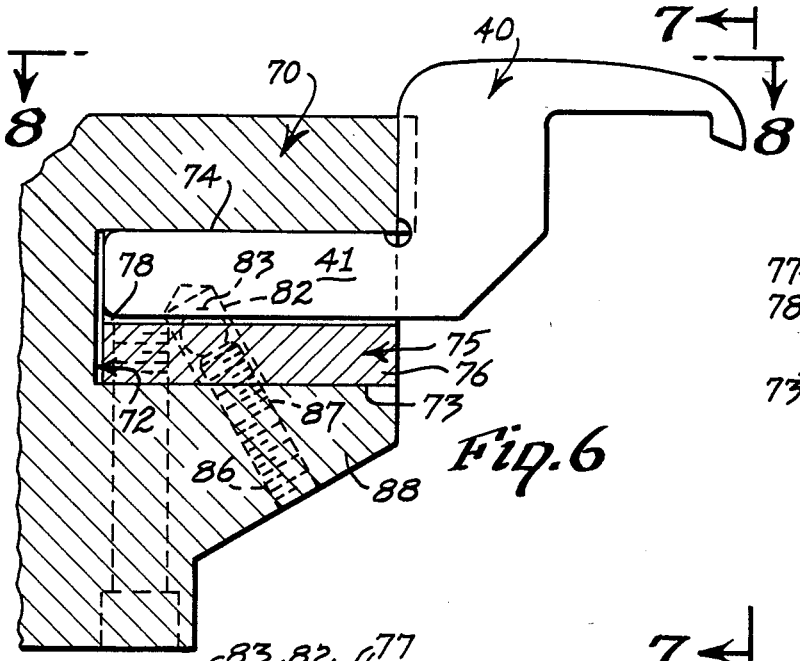
FIG. 6 is a fragmentary sectional elevation taken along the line 6—6 of FIG. 7, longitudinally through a portion of a cut-pile looper apparatus, including a second embodiment of the clamp assembly.
Figure 7:
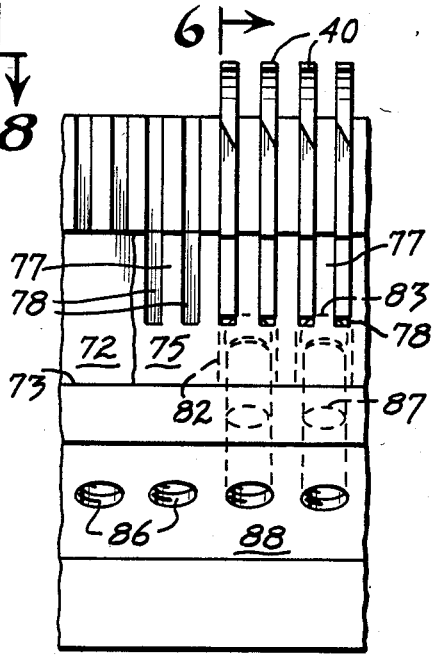
FIG. 7 is a fragmentary front elevation of the looper apparatus taken along the line 7—7 of FIG. 6.
Figure 8:
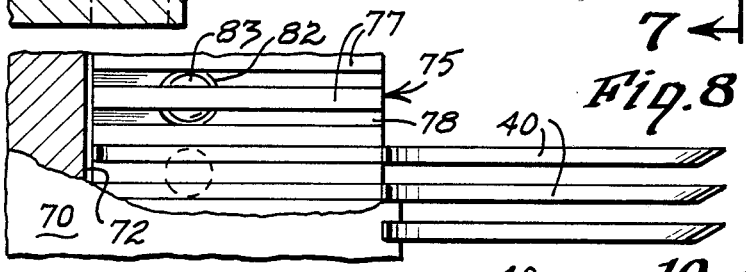
FIG. 8 is a fragmentary top plan view of the apparatus taken along the line 8—8 of FIG. 6, with portions broken away.

FIGS. 6–8 disclose a second embodiment of a looper apparatus including a hook bar 70 having a recess 72 of a height less than the height of the recess 30 in the hook bar 20. The bottom portion of the hook bar 70 is substantially thicker, and therefore stronger, and projects forward to form a lower recess surface 73 opposing upper recess surface 74. The recess 72 receives a transverse gauge bar or gauge member 75 of substantially the same construction as the gauge bar 35, except that the gauge bar 75 is not provided with the vertical stiffener extensions, such as the stiffener extensions 60 disclosed in FIG. 1. The gauge bar 75 includes the bottom wall portion 76 from which project upwardly the lands 77 forming the hook slots 78 which open at the top, and which are adapted to receive the corresponding shanks 41 of the hooks 40.

The bottom wall member 76 of the gauge member 75 includes ball cavities 82 receiving clamp balls 83 for intercepting and engaging the opposed interior bottom corner edges of adjacent shanks 41, in the same manner as the clamp assembly incorporated in the gauge bars 35 of FIGS. 1–4.

Threaded holes 86 are formed through the lower portion 88 of the hook bar 70 in the same manner that they extend through the clamping insert 55 of FIG. 1, to receive the set screws 87.

The threaded holes 86 are also smaller in diameter than the corresponding ball clamps 83 and the ball clamp cavities 82. Thus, as long as the gauge insert 75 is contained within the recess 72, the clamp balls 83 are captive within their respective cavities 82, whether or not the set screws 87 are received in their respective threaded holes 86.

Figure 9:
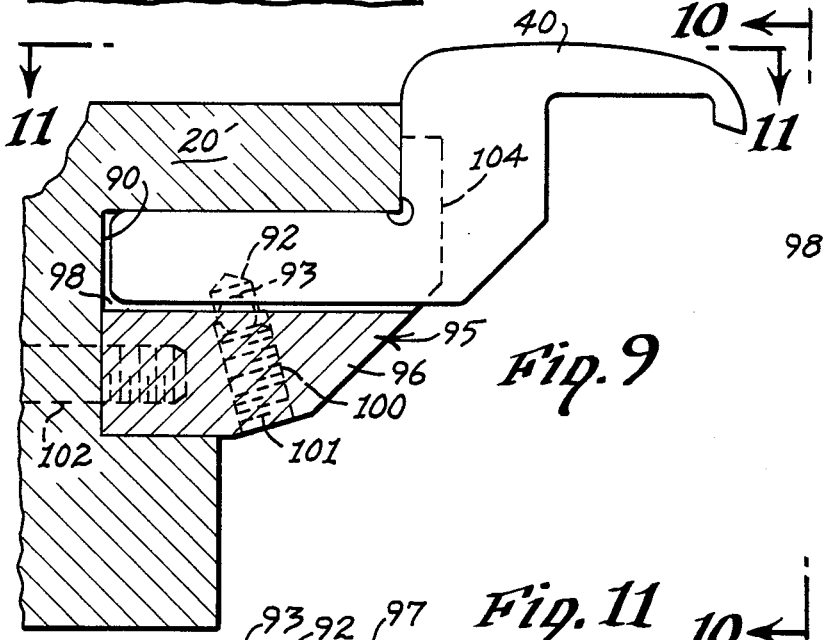
FIG. 9 is a fragmentary sectional elevation taken along the line 9—9 of FIG. 10, longitudinally through a portion of a cut-pile looper apparatus, including a third embodiment of the clamp assembly.
Figure 10:
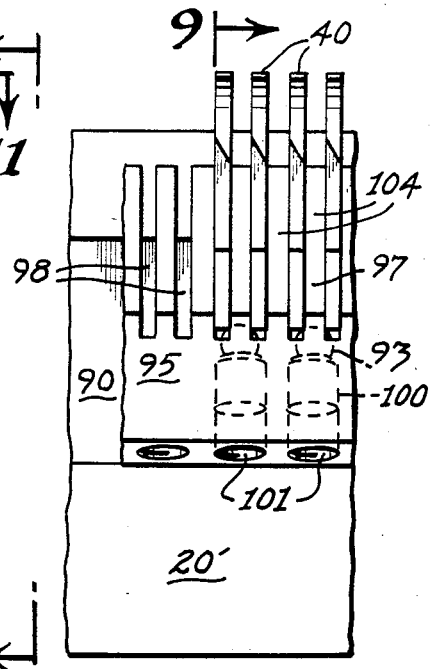
FIG. 10 is a fragmentary front elevation of the looper apparatus taken along the line 10—10 of FIG. 9.
Figure 11:
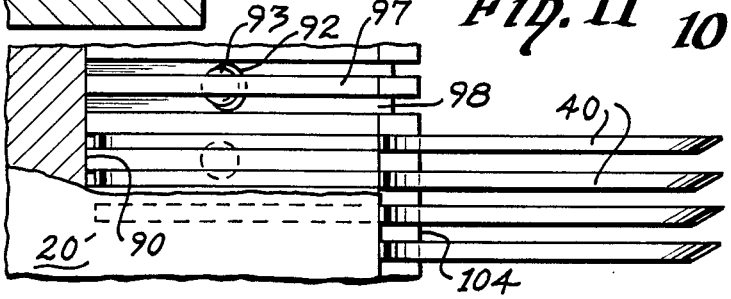
FIG. 11 is a fragmentary top plan view of the looper apparatus taken along the line 11—11 of FIG. 9, with portions broken away.
Figure 13:
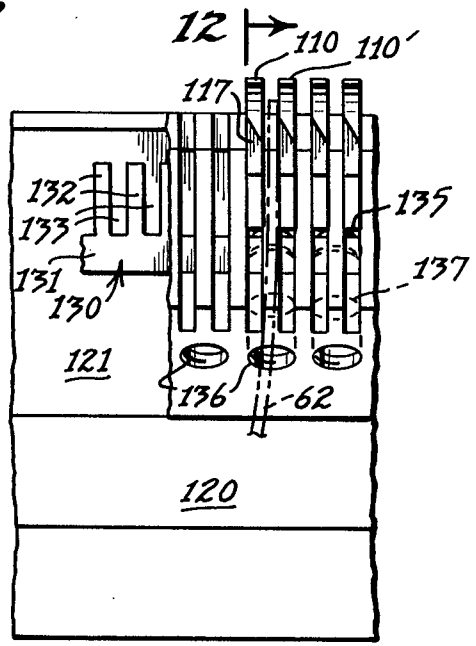
FIG. 13 is a fragmentary front elevation of the looper apparatus, taken along the line 13—13 of FIG. 12.

In the third embodiment of the looper apparatus disclosed in FIGS. 9–11, the hook bar 20' in FIG. 9 is practically identical to the hook bar 20 in FIG. 1, and the gauge bar 95 is of substantially the same construction as the gauge bar 35 in combination with the clamping insert 55. Instead of the gauge bar 35 being pinned to the clamping insert 55, the entire gauge bar 95 is monolithic, thus eliminating a separate clamping insert 55. The gauge bar 95 has a relatively thick bottom wall portion 96 having upward projecting transversely spaced lands 97 defining hook slots 98, each hook slot receiving respectively adjacent loop hooks 40.

Set screws 100 are threadedly secured in the corresponding set screw holes 101 formed in the bottom wall portion 96. Each set screw hole 101 projects upwardly into a corresponding vertically aligned land 97 and intersects the pair of adjacent hook slots 98 on opposite sides of the land 97, as illustrated in FIGS. 10 and 11. However, because the set screw hole 101 is integral with the gauge bar 95, a clamp ball 93 must be small enough to be initially inserted through the set screw hole 101 and into its corresponding coaxial ball cavity 92. Thus, each clamp ball 93 can only be retained in its ball cavity 92 when the set screw 100 is inserted and secured within its corresponding threaded hole 101.

The gauge bar 95 is retained in the recess 90 by a plurality of bolts 102 extending horizontally from the rear of the hook bar 20', as best illustrated in FIG. 9.

The gauge bar 95 is provided with the reinforcing stiffener lands 104, in the same manner as the gauge bars 35 are provided with the stiffener lands 60, for reinforcing the respective looper hooks 40.

Thus, the assembly advantage of the one-piece gauge bar 95 incorporating its own ball clamps 93 and set screws 100 sacrifices the advantage of a gauge bar 35 in which the clamp ball 53 can be retained against inadvertent loss should the set screw be completely removed from the set screw hole.

The looper apparatus disclosed in FIGS. 12–15 is particularly adapted to support a plurality of low profile hooks 110 and 110' having shanks 111 and short heads or necks 112. Each hook 110 and 110' has a rear vertical shoulder 113, a bill 114, a barbed end 115, a cutting edge 116 and a vertical throat 117. Since the necks 112 and throats 117 are relatively short compared with conventional hooks 40, and since cutting knives, such as knives 62 are positioned at an angle of approximately 8° to lean against the corresponding throats 47 and 117 of the respective hooks 40 and 110, low profile hooks 110 and 110' may be spaced on finer gauges because their short throats 117 can accommodate angular knives 62 with a minimum of interference with adjacent looper hooks. (See FIG. 13)

Figure 12:
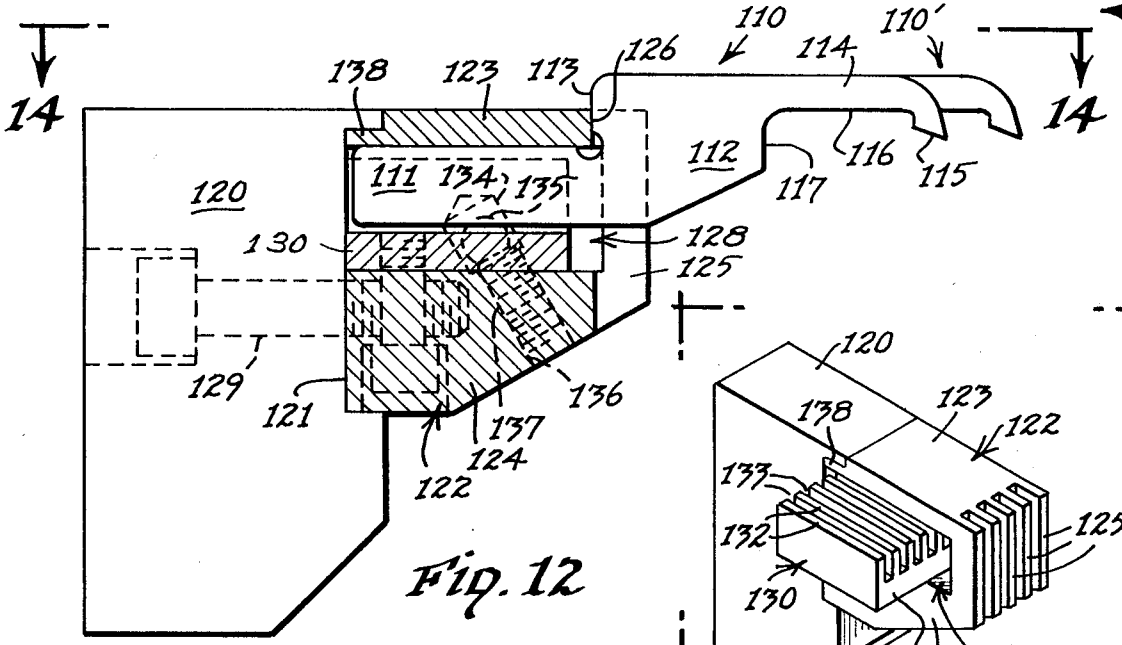
FIG. 12 is a fragmentary sectional elevation taken along the line 12—12 of FIG. 13, longitudinally through a portion of a cut pile looper apparatus having low profile looper hooks, and including a fourth embodiment of the clamp assembly.
Figure 15:
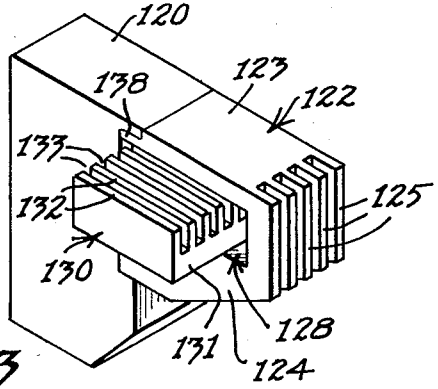
FIG. 15 is a reduced top front perspective view of the looper apparatus of FIGS. 12–14, with the looper hooks removed.
Figure 14:
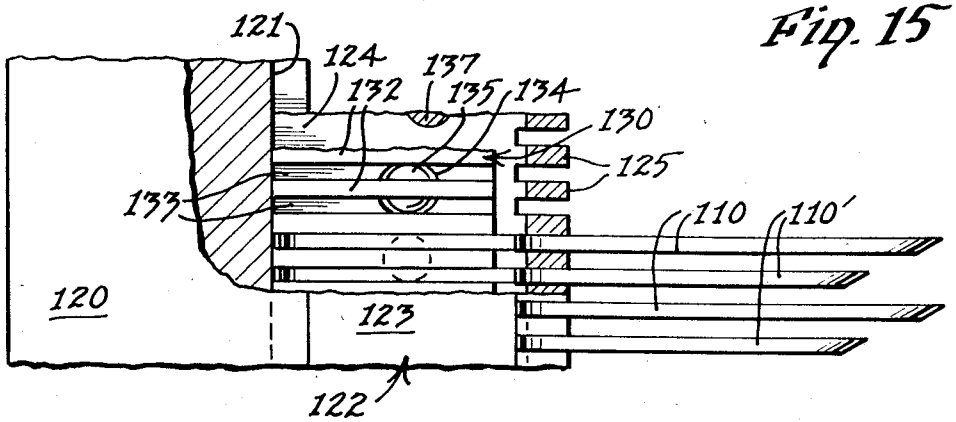
FIG. 14 is a fragmentary top plan view of the looper apparatus taken along the line 14—14 of FIG. 12, with portions broken away.

As best disclosed in FIGS. 12 and 15, the looper mounting apparatus includes a backup bar 120 having a shallow transverse vertical recess 121 for receiving a hook bar 122 of unique construction.

The hook bar 122 includes a top wall member 123 which is relatively thin compared with the top walls of the hook bars disclosed in FIGS. 1–11. The top wall 123 is connected to a thicker bottom wall portion 124 by a plurality of transversely spaced vertically extending front stiffener flanges 125. The top wall portion 123 and the bottom wall portion 124 are spaced apart to form a transverse recess 128, preferably open at its rear and adapted to receive the transverse gauge bar or gauge insert 130.

The rear edge of the top wall portion 123 is recessed to form a rearward projecting tongue 138 to fit within the upper portion of the transverse recess 121 when the hook bar 122 and the gauge bar 130 are assembled in the back-up bar 120. The hook bar 122 is secured to the back-up bar 120 by bolts 129.

The gauge bar 130 is similar to the gauge bar 75 disclosed in FIGS. 6–8, including a solid bottom wall portion 131 with upward projecting lands 132 defining the hook slots 133.

An enlarged ball cavity 134 is formed in the bottom wall portion 131 of the gauge bar 130 for receiving a clamp ball 135. The cavity 134 is in vertical alignment with each alternate land 132 and intersects the adjacent slots 133 on opposite sides of the corresponding land 132, in the same manner as the cavities 52 in FIGS. 1–5 are formed. A set screw hole 136 is inclined and colinear with each corresponding ball cavity 134 and of smaller diameter than the corresponding clamp ball 135 to trap the ball 35 within its corresponding cavity 134 when the gauge bar 130 is received within the recess 128. A set screw 137 is threadedly engaged with each set screw hole 136 and is long enough to project into the ball cavity 134 for forcing the clamp ball 135 up into engagement with the opposite inner bottom corners of the corresponding adjacent pair of hook shanks 111, in the same manner as previously described with respect to the other clamp assemblies.

The stiffener flanges 125 not only serve to rigidly and integrally connect the top wall portion 123 with the bottom wall portion 124 of the hook bar 122, but also function to reinforce and space the necks 122 of the corresponding low profile hooks 110 and 110', when the shoulders 113 abut flush against the front faces 126 of the top wall portion 123 of the hook bar 122.

It is therefore apparent that a clamp assembly has been developed for retaining the tufting hooks within a hook bar in which each clamp ball is utilized to clamp a pair of adjacent hooks with a single set screw and in which the ball transfers the load equally to the two hooks. With this type of clamping assembly, it has been found that the hooks remain secure and tight within their respective hook bars. Moreover, only half as many set screws are needed to securely clamp all of the hooks within the hook bar, thus permitting larger, and therefore stronger set screws, closer spacing of the set screws to permit finer gauge hooks, and the elimination of the overlapping or interlocking hook bar sections having offset ends, thereby facilitating the removal and replacement of hook bar sections, particularly in the middle of the tufting machine.

What is claimed is:

1. A looper apparatus for a multiple needle tufting machine including looper hooks, each hook comprising a neck portion having an upright rear shoulder, a shank portion projecting rearward from the neck portion, and a bill projecting forward from the neck portion, comprising:

(a) a hook bar of solid material having a front face, a rear face, a top portion, a bottom portion, and a transverse dimension, (b) an elongated recess opening through the front face of said hook bar, projecting rearward into said hook bar, and extending transversely of said hook bar, (c) said recess having a top surface and a bottom surface, (d) an elongated gauge member having front, rear, upper and lower portions, and received within said recess, the longitudinal axis of said gauge member extending transversely of said recess, (e) a plurality of transversely spaced hook slots in said gauge member having the same gauge as the needles in the multiple-needle tufting machine, (f) said hook slots being disposed vertically and extending front-to-rear through said gauge member and opening through the front portion of said gauge member, each of said hook slots being adapted to receive the shank portion of a corresponding looper hook projecting rearwardly into said recess, (g) a clamp cavity within said lower portion of said gauge member intersecting a pair of adjacent hook slots, (h) a clamp member within said clamp cavity movable between an upper clamping position projecting into the lower portions of said adjacent hook slots for engaging the shank portions of a pair of looper hooks received in said adjacent hook slots, and a lower non-clamping position disengaging the shank portions of the looper hooks received in said hook slots, (i) screw means for each clamp member within said lower portion of said gauge member in alignment with said clamp cavity for moving said clamp member to said upper clamping position,

2. The invention according to claim 1 in which said gauge member comprises an elongated continuously extending transverse bottom wall portion, there being a clamp cavity in said bottom wall intercepting each successive adjacent pair of hook slots, and a clamp member in each clamp cavity.

3. The invention according to claim 2 in which said hook slots open through the upper portion of said gauge member so that the upper edges of the shank portions of said hooks received in said corresponding hook slots engage the top surface of said recess when said shank portions are forced upwardly by said clamp members in clamping position.

4. The invention according to claim 1 in which said screw means comprises a threaded hole extending through said lower portion of said gauge member and opening into said clamp cavity, and a set screw threadedly engaging said threaded hole for travel into said clamp cavity.

5. The invention according to claim 4 in which the transverse dimension of said clamp member is greater than the diameter of said threaded hole.

6. The invention according to claim 4 in which said clamp cavity is substantially cylindrical and coaxial with said threaded hole.

7. The invention according to clain 6 in which the diameter of said clamp cavity is greater than the diameter of said threaded hole and the transverse dimension of said clamp member is greater than the diameter of said threaded hole.

8. The invention according to claim 4 which the lower portion of said gauge member comprises an elongated separate clamping insert received transversely within the lower portion of said recess, said threaded hole extending upwardly through said clamping insert.

9. The invention according to claim 1 in which said screw means comprises an elongated threaded hole extending upwardly through the bottom portion of said hook bar and in longitudinal alignment with a corresponding clamp cavity, a set screw threadedly engaging said threaded hole for reciprocable travel into said clamp cavity.

10. The invention according to claim 1 in which said clamp member comprises a clamp ball, said screw means comprising a set screw adapted to project into said cavity for engagement with said clamp ball and to move said clamp ball into said clamping position engaging opposed bottom corners of the shank portions of said adjacent looper hooks.

11. The invention according to claim 1 in which said top and bottom portions of said hook bar are joined across the front opening of said recess by a plurality of vertical flanges transversely spaced to receive the respective looper hooks between said adjacent flanges.

* * * * *